United States Patent [19]

Matsuoka

[11] 4,416,240

[45] Nov. 22, 1983

[54] DEVICE AND METHOD FOR CONTROLLING FUEL INJECTED INTERNAL COMBUSTION ENGINE PROVIDING HOT DECELERATION ENRICHMENT

[75] Inventor: Hiroki Matsuoka, Susono, Japan

[73] Assignee: Toyota Jidosha Kabushiki Kaisha, Aichi, Japan

[21] Appl. No.: 372,387

[22] Filed: Apr. 27, 1982

[30] Foreign Application Priority Data

Jun. 4, 1981 [JP] Japan ..... 56-86295

[51] Int. Cl.[3] ..... F02D 17/00

[52] U.S. Cl. ..... 123/493; 123/492; 123/491; 123/480; 123/325

[58] Field of Search ..... 123/492, 493, 486, 480, 123/440, 489, 464, 325, 478; 364/431.05, 431.12

[56] References Cited

U.S. PATENT DOCUMENTS

| | | | |
|---|---|---|---|
| 4,245,605 | 1/1981 | Rice et al. | 123/493 |
| 4,266,522 | 5/1981 | Williams et al. | 123/493 |
| 4,274,382 | 6/1981 | Sugasawa et al. | 123/493 |
| 4,276,863 | 7/1981 | Sugasawa et al. | 123/493 |
| 4,356,803 | 11/1982 | Muyagi | 123/492 |
| 4,359,993 | 11/1982 | Carlson | 123/492 |
| 4,363,307 | 12/1982 | Amano et al. | 123/492 |

*Primary Examiner*—Raymond A. Nelli

*Attorney, Agent, or Firm*—Stevens, Davis, Miller & Mosher

[57] ABSTRACT

A method for controlling an internal combustion engine equipped with a fuel injection valve fitted to its intake manifold. Repeatedly values are determined of a first quantity approximately representing the proper amount of fuel to be injected, at least partly based upon signals from an air flow meter and a revolution sensor. Simultaneously, repeatedly the current value of a second quantity approximately representing the actual amount of fuel to be injected is determined, at least partly based upon signals from the air flow meter and the revolution sensor, an average value of all the successive instances of the value of the first quantity in some time interval up to the present is determined, and the current value of the first quantity is compared with this average. It is determined whether or not the engine is being decelerated, according to whether this current value is less than this average value; and if the engine is being decelerated and is also fully warmed up, then the current value of the second quantity is increased somewhat, so as to produce an adjusted value corresponding to proper fuel amount. Optionally the adjusted value may be further adjusted. At proper points in the operational cycle of the engine, the fuel injection valve is opened for a period which allows approximately the fuel amount represented by the adjusted value to be injected. A device is also explained, incorporating a digital computer, which practices this method.

14 Claims, 5 Drawing Figures

DEVICE AND METHOD FOR CONTROLLING FUEL INJECTED INTERNAL COMBUSTION ENGINE PROVIDING HOT DECELERATION ENRICHMENT

BACKGROUND OF THE INVENTION

The present invention relates to a control device and method for an internal combustion engine equipped with a fuel injection system; and more particularly relates to a control device, incorporating a plurality of sensors and an electronic control computer which receives signals from said sensors and which controls said fuel injection system of said internal combustion engine, said control device accurately and appropriately controlling the amount of fuel supplied by said fuel injection system during deceleration of the internal combustion engine when the engine is fully warmed up so as to avoid misfiring or surging and torque fluctuation, and to a control method for said internal combustion engine equipped with a fuel injection system, said control method being practiced by said device.

Fuel injection is becoming a more and more popular method of fuel supply to gasoline internal combustion engines of automotive vehicles nowadays. This is because of the inherently greater accuracy of metering of liquid fuel by fuel injection techniques as opposed to the metering of liquid fuel available in a carburetor type fuel supply system. In many cases the advantages obtained by this greater accuracy of fuel metering provided by a fuel injection system outweigh the disadvantage of the increased cost thereof. For example, this better fuel metering enables engine designers to produce engines with higher compression ratio and more spark advance, which can lead to increased performance characteristics, such as increased power, increased torque, and better engine elasticity.

Because a fuel injection system can accurately determine the amount of fuel to be supplied to the intake system of the vehicle in a wide variety of engine operational conditions, it is possible to operate the engine in a way which generates substantially lower levels of harmful exhaust emissions such as NOx, HC, and CO; and in fact it is possible to satisfy the legal requirements for cleanliness of vehicle exhaust gases, which are becoming more and more severe nowadays, without providing any exhaust gas recirculation for the engine. This is very beneficial with regard to drivability of the engine, especially in idling conditions. Further, because of the higher efficiency of fuel metering available, this allows a leaner adjustment of the engine with still acceptable drivability. With fuel injection provided to a vehicle type, more consistent exhaust emission results are available from vehicles coming off the assembly line at the factory, without complicated, troublesome, and expensive individual adjustments. Further, the warmup control of the vehicle is highly flexible, i.e. can be flexibly adjusted to a wide variety of warming up conditions, which contributes considerably to the achieved exhaust emission results.

Further, an internal combustion engine equipped with a fuel injection system can be operated in such a way as to be substantially more economical of gasoline than a carburetor type internal combustion engine. This is again because of the greater accuracy available for determination of the amount of fuel to be supplied to the intake system of the vehicle over a wide variety of engine operational conditions. Since it is possible to operate the engine at the stoichiometric air/fuel ratio, and to apply closed loop control to the fuel injection control system, it is possible to reduce the spark retardation, the above mentioned dispensing with exhaust gas recirculation is possible, which has a significant beneficial effect with regard to fuel consumption. Further, with fuel injection, it is possible to cut off fuel supply entirely when the engine is operating in an overrun mode, which again results in a significantly reduced consumption of fuel. Nowadays, with the increased costs of fuel and the wider demand for fuel economical vehicles, and with legal requirements which are being introduced in some countries relating to fuel economy of automotive vehicles, these considerations are becoming more and more very important. In addition, by the introduction of fuel injection, a smaller piston displacement engine can replace an engine with larger piston displacement which is provided with a carburetor type fuel supply system, while providing the same output power, and again this reduces fuel consumption. By the introduction of fuel injection, also, in many cases it is possible to switch an engine from premium grade type fuel operation to operation on lower grade regular type fuel, while providing the same output power, which is economical of the more expensive premium grade type fuels.

Some types of fuel injection system for internal combustion engines utilize mechanical control of the amount of injected fuel. An example of this mechanical fuel amount control type of fuel injection system is the so called K-jetronic type of fuel injection system. However, nowadays, with the rapid progress which is being attained in the field of electronic control systems, various arrangements have been proposed in which electronic control circuits make control decisions as to the amount of fuel that should be supplied to the internal combustion engine, in various engine operational conditions. Such electronic fuel injection systems are becoming much more popular, because of the more flexible way in which the fuel metering can be tailored to various different combinations of engine operational conditions. The most modern of these electronic fuel injection systems use a microcomputer such as an electronic digital computer to regulate the amount of fuel injected per one engine cycle, and it is already conventionally known to use the microcomputer also to regulate various other engine functions such as the provision of ignition sparks for the spark plugs.

In an electronic fuel injection system, the control system requires of course to know the moment by moment current values of certain operational parameters of the internal combustion engine, the amount of injected fuel being determined according to these values. The current values of these operational parameters are sensed by sensors which dispatch signals to the electronic control system via A/D converters and the like. In such an arrangement, electric signals are outputted by such an electronic control system to an electrically controlled fuel injection valve, so as to open it and close it at properly determined instants separated by a proper time interval; and this fuel injection valve is provided with a substantially constant supply of pressurized gasoline from a pressure pump. This pressurized gasoline, when the fuel injection valve is opened, and during the time of such opening, is squirted through said fuel injection valve into the intake manifold of the internal combustion engine upstream of the intake valves thereof.

Thus, the amount of injected gasoline is substantially proportional to the time of opening of the fuel injection valve, less, in fact, an inoperative time required for the valve to open. Sometimes only one fuel injection valve is provided for all the cylinders of the internal combustion engine, or alternatively several fuel injection valves may be provided, up to one for each cylinder of the engine, according to design requirements.

The first generation of fuel injection systems were of the so called D-jetronic type, in which the main variables monitored by the electronic fuel injection control system were the revolution speed of the internal combustion engine and the vacuum, or depression, present in the intake manifold of the internal combustion engine, due to the suction in said intake manifold produced by the air flow passing through the intake manifold of the internal combustion engine to enter the combustion chambers thereof after being mixed with liquid fuel squirted in through the fuel injection valve or valves. From these two basic measured internal combustion engine operational parameters, a basic amount of gasoline to be injected into the intake system of the internal combustion engine is determined by the control system, and then the control system controls the fuel injection valve so as to inject this amount of gasoline into the engine intake system. Other variables, such as intake air temperature, engine temperature, and others, are further measured in various implementations of the D-jetronic system and are used for performing corrections to the basic fuel injection amount.

Following this, the second generation of fuel injection systems has been developed, which is of the so called L-jetronic type, in which the main variables monitored by the electronic fuel injection control system are the revolution speed of the internal combustion engine and the amount of air flow passing through the intake manifold of the internal combustion engine to enter the combustion chambers thereof after being mixed with liquid fuel squirted in through the fuel injection valve or valves. This air flow amount is measured by an air flow meter of a design which has become developed. From these two basic measured internal combustion engine operational parameters, again a basic amount of gasoline to be injected into the intake system of the internal combustion engine is determined by the control system, and then the control system controls the fuel injection valve so as to inject this amount of gasoline into the engine intake system. Other variables, such as intake air temperature, engine temperature, and others, are again further measured in various implementations of the L-jetronic system, and are used for performing corrections to the basic fuel injection amount. This L-jetronic fuel injection control system is currently well known and is nowadays fitted to a large number and variety of vehicles.

One refinement that has been made to the L-jetronic fuel injection system has been to perform a control of the fuel injection amount based upon feedback from an air/fuel ratio sensor which is fitted to the exhaust manifold of the internal combustion engine and which detects the concentration of oxygen in these exhaust gases, again in a per se well known way. This feedback control homes in on a proper amount of fuel injection to provide a stoichiometric air/fuel ratio for the intake gases sucked into the cylinders of the engine, and for the exhaust gases of the engine, but the starting point region over which the homing in action of the feedback control system is effective is limited, and therefore the determination of the approximately correct amount of fuel to be injected by the fuel injection valve is still very important, especially in the case of transient operational conditions of the engine.

One difficulty that has occurred with such normal spark ignition engines which are equipped with the L-jetronic form of electronic fuel injection system is that, when the engine is fully warmed up to operational temperature and then is decelerated, misfiring tends to occur. As a result of this misfiring, consequential engine surging and torque fluctuation is liable to occur. It has been determined experimentally that this problem of misfiring and consequent engine surging and torque fluctuation can be at least partially cured by increasing the amount of fuel injected into the internal combustion engine at this time. Accordingly, a requirement has arisen for a fuel injection system which can provide this extra fuel injection supply at times of deceleration when the internal combustion engine is fully warmed up.

Further, it has been also experimentally determined that it is desirable for the amount of this hot deceleration extra injected fuel to be gradually and progressively decreased as the deceleration of the internal combustion engine progresses. This is particularly helpful with regard to diminishing of the amount of harmful pollutants emitted in the exhaust of the internal combustion engine, in particular HC and CO. Thus, further a requirement has arisen for a fuel injection system which can provide this diminishing of the extra fuel injection supply at times of deceleration when the internal combustion engine is fully warmed up.

With regard to such requirements, the question arises as to how the fuel injection system control system can acquire information as to whether or not, and when, the internal combustion engine is being operated in a deceleration operational condition. This information could be provided to the fuel injection system by providing a throttle position sensor for detecting the amount of throttle opening of the vehicle; but such a throttle position sensor is costly, involves additional problems during assembly and maintenance of the fuel injection system, and further is liable to breakdown. Further, since for the best possible deceleration detection such a throttle position sensor needs to be one from whose output signal even partial deceleration of the vehicle can be detected, in other words needs to be one whose signal is indicative not only of deceleration which is produced by complete closing of the vehicle throttle but also of deceleration which is produced by partial closing of said vehicle throttle, a simple throttle limit switch which only detects full closing of the vehicle throttle is not really adequate for this purpose.

SUMMARY OF THE INVENTION

Accordingly, it is the primary object of the present invention to provide a method for controlling an internal combustion engine which is equipped with an electronic fuel injection system, and a device which implements the method, which can perform a correction to increase the basic fuel injection amount provided by the fuel injection system, during deceleration of the internal combustion engine when it is fully warmed up, so as to hinder engine misfiring and surging and torque fluctuation.

It is a further object of the present invention to provide such a method for controlling an internal combustion engine which is equipped with an electronic fuel injection system, and a device which implements the method, which can perform a correction to increase the basic fuel injection amount provided by the fuel injection system, during deceleration of the internal combustion engine when it is fully warmed up, so as to hinder engine misfiring and surging and torque fluctuation, and which do not require any particular sensor to be provided for detecting the position of the throttle of the intake system of the engine.

It is a further object of the present invention to provide such a method for controlling an internal combustion engine which is equipped with an electronic fuel injection system, and a device which implements the method, which detect that the engine is in the deceleration operational condition from signals dispatched by the basic sensors provided for the L-jetronic fuel injection system for the engine, without requiring any additional throttle position sensor.

It is a further object of the present invention to provide such a method for controlling an internal combustion engine which is equipped with an electronic fuel injection system, and a device which implements the method, which detect that the engine is in the deceleration operational condition from the signals dispatched by an engine revolution speed sensor and by an intake air flow sensor.

It is a further object of the present invention to provide such a method for controlling an internal combustion engine which is equipped with an electronic fuel injection system, and a device which implements the method, which detect a specified above that the engine is in the deceleration operational condition, not only when the throttle of the internal combustion engine is completely closed from an open condition, but also when the throttle of the internal combustion engine is partly closed from a first at least partially open condition to a second at least somewhat less open condition.

It is a further object of the present invention to provide such a method for controlling an internal combustion engine which is equipped with an electronic fuel injection system, and a device which implements the method, which can attain the above object, without the provision of any particular throttle sensor for detecting the position of the throttle of the intake system of the engine.

It is a further object of the present invention to provide such a method for controlling an internal combustion engine which is equipped with an electronic fuel injection system, and a device which implements the method, which can perform a correction as described above to increase the basic fuel injection amount provided by the fuel injection system, during deceleration of the internal combustion engine when it is fully warmed up, so as to hinder engine misfiring and surging and torque fluctuation, and which further, after once said correction to increase the basic fuel injection amount provided by the fuel injection system during deceleration of the internal combustion engine when it is fully warmed up has been started to be provided, gradually decreases the amount of said increasing correction until it reaches zero, so as to improve the quality of exhaust emissions of the internal combustion engine and so as to avoid the output of harmful pollutants as much as possible.

It is yet a further object of the present invention to provide such a method for controlling an internal combustion engine which is equipped with an electronic fuel injection system, and a device which implements the method, which are not prone to breakdown during use.

It is yet a further object of the present invention to provide such a method for controlling an internal combustion engine which is equipped with an electronic fuel injection system, and a device which implements the method, which do not involve undue expense in manufacture of the fuel injection system.

It is yet a further object of the present invention to provide such a method for controlling an internal combustion engine which is equipped with an electronic fuel injection system, and a device which implements the method, which do not involve undue difficulty in manufacture of the fuel injection system.

It is yet a further object of the present invention to provide such a method for controlling an internal combustion engine which is equipped with an electronic fuel injection system, and a device which implements the method, which do not involve undue difficulty in maintenance of the fuel injection system.

According to the method aspect of the present invention, these and other objects are accomplished by, for an internal combustion engine comprising an intake manifold and a fuel injection valve fitted to said intake manifold which is selectively opened and closed by selective supply of an actuating signal thereto and which when so opened injects liquid fuel into said intake manifold, said internal combustion engine having an operational cycle: an engine control method, comprising the processes, repeatedly and simultaneously performed, of: (a) sensing the flow rate of air into said intake manifold with an intake air flow meter which measures the flow rate of air into said intake manifold and which outputs an intake air flow rate signal representative of said air flow rate; (b) sensing the revolution of said internal combustion engine with an engine revolution sensor which responds to revolution of said internal combustion engine and which outputs an engine revolution signal representative of said internal combustion engine revolution; (c) determining at a sequence of instants separated by successive intervals successive instances of the value of a first quantity approximately representing the proper amount of fuel to be injected through said fuel injection valve, said determination being at least partly based upon said intake air flow rate signal and said engine revolution signal; (d) performing the following processes in the specified order: (d0) determining the current value of a second quantity approximately representing the actual amount of fuel to be injected through said fuel injection valve, said determination being at least partly based upon said intake air flow rate signal and said engine revolution signal; (d1) determining an average value of all said successive instances of the value of said first quantity approximately representing the proper amount of fuel to be injected through said fuel injection valve which have been determined in some time interval up to the present; (d2) comparing the current value of said first quantity approximately representing the proper amount of fuel to be injected through said fuel injection valve with said average value and based thereupon determining whether or not said internal combustion engine is being decelerated at the present time, respectively according to whether said current value is less than said average value, or not; (d3) if, according to said comparison, it is so determined that said internal combustion engine is being decelerated at the present time, and if it is also determined that said internal combustion engine is fully warmed up at the present time, adjusting the current value of said second quantity approximately representing the actual amount of fuel to be injected through said fuel injection valve by increasing it somewhat, so as to produce an adjusted value corresponding to the actual fuel amount; and optionally (d4) further adjusting said adjusted value corresponding to the actual fuel amount; and (e) at proper fuel injection points in said operational cycle of said internal combustion engine, modifying said actuating signal according to the current adjusted value of said second quantity and supplying the modified actuating signal to said fuel injection valve in such a fashion as to cause said fuel injection valve to open for a time period which will allow an amount of fuel approximately equal to the fuel amount represented by said current adjusted value of said second quantity corresponding to the actual fuel amount to pass through said fuel injection valve so as to be injected into said intake manifold.

According to such a method, it is possible to determine whether or not the internal combustion engine is being decelerated or not, without using any special sensor for detecting the position of the throttle valve thereof, but only using the intake air flow rate signal from said intake air flow meter and the engine revolution signal from said engine revolution sensor, which in any case are required to be provided for such a so called L-jetronic system of control of a fuel injected internal combustion engine; and thus it is possible to perform hot deceleration injected fuel amount increase for the internal combustion engine without particularly providing any special sensor which otherwise would not be required. Thereby an efficiency in operation of this method is made possible, and concomitant reductions in cost, difficulty of manufacturing and servicing, and likelihood of breakdown also accrue.

Further, according to a particular method aspect of the present invention, these and other objects are more particularly and concretely accomplished by an engine control method as described above, wherein said first quantity is calculated by dividing said intake air flow rate as measured by said intake air flow rate signal output by said intake air flow meter by the revolution speed of said internal combustion engine as measured by said engine revolution signal output by said engine revolution sensor.

According to such a method, said first quantity is calculated simply without taking any particular account of inherent errors in the air flow meter or the like, and is not particularly normalized to represent an actual fuel injection amount, since said first quantity is simply used for a comparison between different of its values, in step (d2).

Further, according to a particular aspect of the present invention, these and other objects are more particularly and concretely accomplished by an engine control method as described above, wherein said second quantity is calculated by dividing said intake air flow rate as measured by said intake air flow rate signal output by said intake air flow meter by the revolution speed of said internal combustion engine as measured by said engine revolution signal output by said engine revolution sensor, and by then adjusting this value by multiplication by a certain constant value.

According to such a method, said second quantity is calculated by taking account of inherent errors in the air flow meter or the like, by multiplication by said certain constant value, and is also thus normalized to represent an actual fuel injection amount, since in step (e) the adjusted value of said second quantity will be used as a basis for control of said fuel injection valve, so as to control the amount of fuel injected through said fuel injection valve into said intake manifold.

Further, according to a yet more particular aspect of the present invention, these and other objects are more particularly and concretely accomplished by any single one of the methods described above, wherein the time interval up to the present over which said average value of all said successive instances of said value of said first quantity approximately representing the proper amount of fuel to be injected through said fuel injection valve is determined is in each repeated case of determination such a time interval up to the present that contains the same constant number of said instances of said value.

According to such a method, by such steady taking of the average value of said successive instances of said value of said first quantity, instability in the determination of said average value over a period of time can be reduced, and said determination in step (d2) as to whether said internal combustion engine is being decelerated or not can be more reliably performed.

Further, according to an even yet more particular aspect of the present invention, these and other objects are more particularly and concretely accomplished by any single one of the methods described above, wherein the amount of said adjustment to increase somewhat the current value of said second quantity approximately representing the proper amount of fuel to be injected through said fuel injection valve performed in step (d3) is set to maximum when first according to said comparison in step (d2) it is so determined that said internal combustion engine is being decelerated at the present time and it is also determined that said internal combustion engine is fully warmed up at the present time, and from this time said amount of said adjustment to increase somewhat the current value of said second quantity approximately representing the proper amount of fuel to be injected through said fuel injection valve is gradually decreased until it reaches zero.

According to such a method, the amount of said hot deceleration injected fuel increase can be gradually and progressively decreased over a characteristic time period till it reaches zero, which has been experimentally determined to be desirable from the point of view of avoiding engine misfiring and surging and torque fluctuation, as already explained, while at the same time emitting as little a quantity of possible of noxious pollutants in the exhaust gases of the internal combustion engine.

Further, according to the most general device aspect of the present invention, these and other objects are accomplished by, for an internal combustion engine comprising an intake manifold and a fuel injection valve fitted to said intake manifold which is selectively opened and closed by selective supply of a fuel injection valve actuating signal thereto and which when so opened injects liquid fuel into said intake manifold, said internal combustion engine having an operational cycle: an engine control device, comprising: (a) an intake air flow meter which repeatedly measures the flow rate of air into said intake manifold and which outputs an intake air flow rate electrical signal representative of said air flow rate; (b) an engine revolution sensor which repeatedly responds to revolution of said internal combustion engine and which outputs an engine revolution electrical signal representative of said internal combustion engine revolution; (c) an I/O device, which, whenever it receives a fuel injection valve control electrical signal, dispatches said fuel injection valve actuating signal to said fuel injection valve; and (d) an electronic computer, which receives supply of said intake air flow rate electrical signal and of said engine revolution electrical signal; (e) said electronic computer repeatedly determining at a sequence of instants separated by successive intervals successive instances of the value of a first quantity approximately representing the proper amount of fuel to be injected through said fuel injection valve, said determination being at least partly based upon said intake air flow rate electrical signal and said engine revolution electrical signal; and also repeatedly performing the following processes in the specified order: (e0) determining the current value of a second quantity approximately representing the actual amount of fuel to be injected through said fuel injection valve, said determination being at least partly based upon said intake air flow rate electrical signal and said engine revolution electrical signal; (e1) determining an average value of all said successive instances of said value of said first quantity approximately representing the proper amount of fuel to be injected through said fuel injection valve which have been determined in some time interval up to the present; (e2) comparing the current value of said first quantity approximately representing the proper amount of fuel to be injected through said fuel injection valve with said average value and based thereupon determining whether or not said internal combustion engine is being decelerated at the present time, respectively according to whether said current value is less than said average value, or not; (e3) if, according to said comparison, it is so determined that said internal combustion engine is being decelerated at the present time, and if it is also determined that said internal combustion engine is fully warmed up at the present time, adjusting the current value of said second quantity approximately representing the proper amount of fuel to be injected through said fuel injection valve by increasing it somewhat, so as to produce an adjusted value corresponding to the actual fuel amount; and optionally (e4) further adjusting said adjusted value corresponding to the actual fuel amount; (f) said electronic computer also at proper fuel injection points in said operational cycle of said internal combustion engine supplying said adjusted second quantity to said I/O device, so as to cause said I/O device to dispatch said fuel injection valve actuating signal according to said adjusted second quantity to said fuel injection valve in such a fashion as to cause said fuel injection valve to open for a time period which will allow an amount of fuel approximately equal to the fuel amount represented by said current adjusted value of said second quantity corresponding to the actual fuel amount to pass through said fuel injection valve so as to be injected into said intake manifold.

According to such a structure, the electronic computer is able to determine whether or not the internal combustion engine is being decelerated or not, without using any special sensor for detecting the position of the throttle valve thereof, but only using the intake air flow rate electrical signal from said intake air flow meter and the engine revolution electrical signal from said engine revolution sensor, which in any case are required to be provided for such a so called L-jetronic system of control of a fuel injected internal combustion engine; and thus it is possible for the electronic computer to perform hot deceleration injected fuel amount increase for the internal combustion engine without particularly providing any special sensor which otherwise would not be required. Thereby an efficiency in operation of this device is made possible, and concomitant reductions in cost of the engine control device, difficulty of manufacturing and servicing, and likelihood of breakdown also accrue.

Further, according to a particular aspect of the present invention, these and other objects are more particularly and concretely accomplished by an engine control device as described above, wherein said electronic computer calculates said first quantity by dividing said intake air flow rate as measured by said intake air flow rate electrical signal output by said intake air flow meter by the revolution speed of said internal combustion engine as measured by said engine revolution electrical signal output by said engine revolution sensor.

According to such a structure, said electronic computer calculates said first quantity simply without taking any particular account of inherent errors in the air flow meter or the like, and does not particularly normalize said first quantity to represent an actual fuel injection amount, since said electronic computer simply uses said first quantity for a comparison between different of its values, in step (e2).

Further, according to a particular aspect of the present invention, these and other objects are more particularly and concretely accomplished by an engine control device as described above, wherein said electronic computer calculates said second quantity by dividing said intake air flow rate as measured by said intake air flow rate electrical signal output by said intake air flow meter by the revolution speed of said internal combustion engine as measured by said engine revolution electrical signal output by said engine revolution sensor, and by then adjusting this value by multiplication by a certain constant value.

According to such a structure, said electronic computer calculates said second quantity by taking account of inherent errors in the air flow meter or the like, by multiplication by said certain constant value, and also thus normalizes said second quantity to represent an actual fuel injection amount, since in step (f) said electronic computer will use the adjusted value of said second quantity as a basis for control of said fuel injection valve, so as to control the amount of fuel injected through said fuel injection valve into said intake manifold.

Further, according to a yet more particular aspect of the present invention, these and other objects are more particularly and concretely accomplished by any single one of the devices described above, wherein the time interval up to the present over which said electronic computer determines said average value of all said successive instances of said value of said first quantity approximately representing the proper amount of fuel to be injected through said fuel injection valve is in each repeated case of determination that time interval up to the present containing the same constant number of said instances of said value.

According to such a structure, by said electronic computer taking in such a steady manner the average value of said successive instances of said value of said first quantity, instability in the determination by said electronic computer of said average value over a period of time can be reduced, and said determination by said electronic computer in step (e2) as to whether said internal combustion engine is being decelerated or not can be more reliably performed.

Further, according to an even yet more particular aspect of the present invention, these and other objects are more particularly and concretely accomplished by any single one of the devices described above, wherein said electronic computer in step (d3) sets to maximum the amount of said adjustment to increase it somewhat of the current value of said second quantity approximately representing the proper amount of fuel to be injected through said fuel injection valve when first according to said comparison in step (d2) it is so determined that said internal combustion engine is being decelerated at the present time and it is also determined that said internal combustion engine is fully warmed up at the present time, and from this time said electronic computer gradually decreases the amount of said adjustment to increase it somewhat of the current value of said second quantity approximately representing the proper amount of fuel to be injected through said fuel injection valve until it reaches zero.

According to such a structure, said digital computer can gradually and progressively decrease the amount of said hot deceleration injected fuel increase over a characteristic time period till it reaches zero, which has been experimentally determined to be desirable from the point of view of avoiding engine misfiring and surging and torque fluctuation, as already explained, while at the same time emitting as little a quantity of possible of noxious pollutants in the exhaust gases of the internal combustion engine.

BRIEF DESCRIPTION OF THE DRAWINGS

The present invention will now be shown and described with reference to a preferred embodiment of both the method and the device thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENT

Now, the present invention will be explained with respect to the particular embodiment thereof, and with reference to the accompanying drawings.

Figure 1:
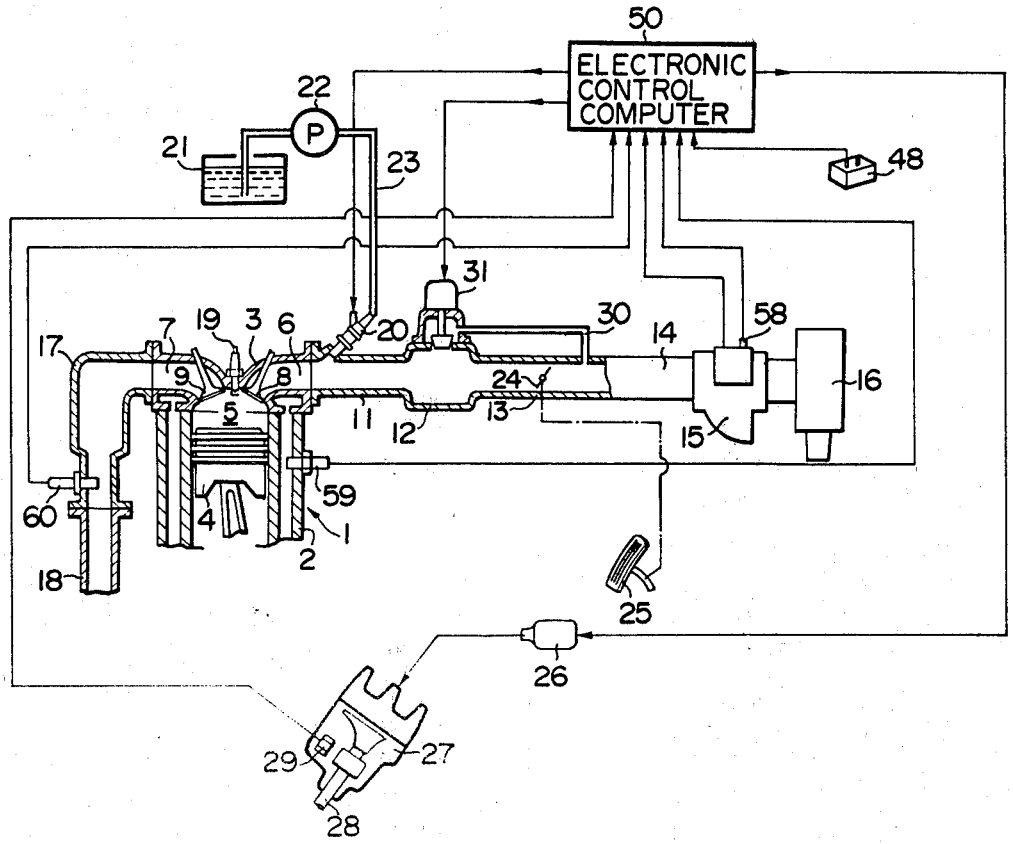
FIG. 1 is a partly schematic partly cross sectional drawing, diagrammatically showing an example of an internal combustion engine which is equipped with a fuel injection system and which is suitable to be controlled by an embodiment of the engine control device according to the present invention, which is of the L-jetronic type incorporating an air flow meter, according to an embodiment of the engine control method of the present invention; this figure also showing in schematic part block diagram form the preferred embodiment of the engine control device according to the present invention, which practices the preferred embodiment of the engine control method according to the present invention, and which controls said internal combustion engine.

In FIG. 1 there is shown a part schematic part cross sectional diagram of an internal combustion engine, generally designated by the reference numeral 1, which is a fuel injection type of engine comprising a fuel injection system which is per se well known, and which is controlled according to the preferred embodiment of the engine control method according to the present invention by the preferred embodiment of the engine control device according to the present invention, as will henceforth be explained.

The internal combustion engine 1 comprises a conventional type of cylinder block 2, within which are formed a plurality of cylinder bores, only one of which can be seen in the drawing. To the top ends of the cylinder bores remote from the crankshaft of the internal combustion engine 1, i.e. to the upper end of the cylinder bore as seen in the figure, there is fitted a cylinder head 3, and within each of the bores there reciprocates a piston 4 in a per se well known way. Thus, the bores, the top surfaces of the pistons 4, and the bottom surface of the cylinder head 3 cooperate in a per se well known way to form a plurality of combustion chambers 5, only one of which, again, can be seen in the drawing.

Each of the combustion chambers 5 is provided with an intake port 6 and an exhaust port 7, and these ports are each respectively controlled by one of a plurality of intake valves 8 or one of a plurality of exhaust valves 9. Further, spark ignition is provided for each combustion chamber 5 by one of a plurality of spark plugs 19, each of which is provided with high tension electrical energy from a coil 26 via a distributor 27, so as to cause said spark plug 19 to spark, in a per se well known way.

To the exhaust ports 7 of the internal combustion engine 1 there is connected an exhaust manifold 17 which leads the exhaust of the engine from the combustion chambers 5 to an exhaust pipe 18, and at an intermediate part of this exhaust pipe 18 there is fitted a three way catalytic converter, in the case of this particular internal combustion engine 1, although this three way catalytic converter is not shown in the figure. To the intake ports 6 of the internal combustion engine 1 there is connected an intake manifold 11 which leads to an intake air surge tank 12. From this surge tank 12 an air intake tube 14 leads via an air flow meter 15 of a per se well known sort (which forms part of the preferred embodiment of the engine control device according to the present invention) to an air cleaner 16. Thus, air flows in from the atmosphere through, in order, this air cleaner 16, the intake tube 14 and the air flow meter 15, the surge tank 12, and the intake manifold 11 to enter into the combustion chambers 5 of the internal combustion engine 1, when sucked in through the intake ports 6 by the pistons 4 on their intake strokes.

To an intermediate part of the intake manifold 11 there is fitted a fuel injection valve 20 of a per se well known electrically controlled sort. This fuel injection valve 20 is supplied with pressurized liquid fuel such as gasoline from a fuel tank 21 by a fuel pump 22 also of a per se well known sort, and the opening and closing of this fuel injection valve 20 are electrically controlled by an electronic control computer 50 which will hereinafter be described, which forms part of the preferred embodiment of the engine control device according to the present invention, and which functions according to the preferred embodiment of the engine control method according to the present invention. Thus, according to the duration of the interval of time between said opening of said fuel injection valve 20 and said closing of said fuel injection valve 20, the amount of liquid fuel such as gasoline injected into the intake manifold 11 per one cycle of operation of said fuel injection valve 20 can be regulated.

A throttle valve 24 which in this shown internal combustion engine 1 is a butterfly type throttle valve is mounted at an intermediate point in the intake tube 14 so as to control its air flow resistance, i.e. its effective cross section, and this throttle valve 24 is controlled by a linkage which is not shown according to the amount of depression of a throttle pedal 25 provided by actuating movement of the foot of the driver of the vehicle which is powered by the internal combustion engine 1. An air bypass passage 30 is provided as leading from upstream of the throttle valve 24 to a point in the surge tank 12, i.e. to a point in the intake system which is downstream of the throttle valve 24; and the flow resistance of this air bypass passage 30 is controlled by an electrically operated bypass flow control valve 31. As will be seen later, this air bypass passage 30 is provided principally for use during the engine idling condition, and is not directly relevant to the essential concept of the present invention. Finally, the internal combustion engine 1 is associated with a battery 48, which provides a source of electrical power for the various systems of the vehicle to which the internal combustion engine 1 is fitted.

This completes the description of the parts of the internal combustion engine 1, and of the associated systems thereof, and of the fuel injection system of the internal combustion engine 1, which are controlled according to the aforesaid preferred embodiment of the engine control method according to the present invention by the preferred embodiment of the engine control device according to the present invention. This engine control device comprises a plurality of sensors which will now be described, and also comprises an electronic control computer 50 which may be a microcomputer, and which will be described shortly with respect to its architecture and its mode of operation. Together, these sensors furnish information to the electronic control computer 50 relating to operational conditions of the internal combustion engine 1, and based upon this information about engine operational conditions the electronic control computer 50 dispatches electrical signals to the fuel injection valve 20, the ignition coil 26, and the bypass flow control valve 31, so as appropriately to operate and control the internal combustion engine 1, according to the aforesaid preferred embodiment of the engine control method according to the present invention. These sensors are: an intake air flow amount or rate signal which is generated by a sensor incorporated in the aforementioned intake air flow meter 15; an intake air temperature signal generated by an intake air temperature sensor 58 which is attached to the air flow meter 15; a cooling water temperature signal generated by a cooling water temperature sensor 59 which is attached to the cylinder block 1 to sense the temperature of the cooling water within the water jacket thereof; an excess air signal generated by an O2 sensor 60 of a per se well known sort which is fitted to the exhaust manifold 17 and which generates said excess air signal which is representative of the air/fuel ratio of the exhaust gases of the internal combustion engine 1 which are being exhausted through said exhaust manifold 17; and a crank angle and engine revolution speed signal which is generated by a revolution sensor 29 fitted to the distributor 27. It should be particularly noted that, in line with the principles of the present invention, there is provided no particular sensor for sensing the position of the throttle valve 24 or of the accelerator pedal 25, because the information regarding deceleration of the internal combustion engine induced by operation of said accelerator pedal and said throttle valve, according to the present invention, will be derived from the other signals dispatched by the sensors listed above, in particular from the intake air flow amount or rate signal which is generated by the sensor incorporated in the aforementioned intake air flow meter 15 and the crank angle and engine revolution speed signal which is generated by the revolution sensor 29 fitted to the distributor 27, as will hereinafter be explained. Thus, according to the engine control method and device according to the present invention, no particular special throttle position sensor needs to be provided.

Figure 2:
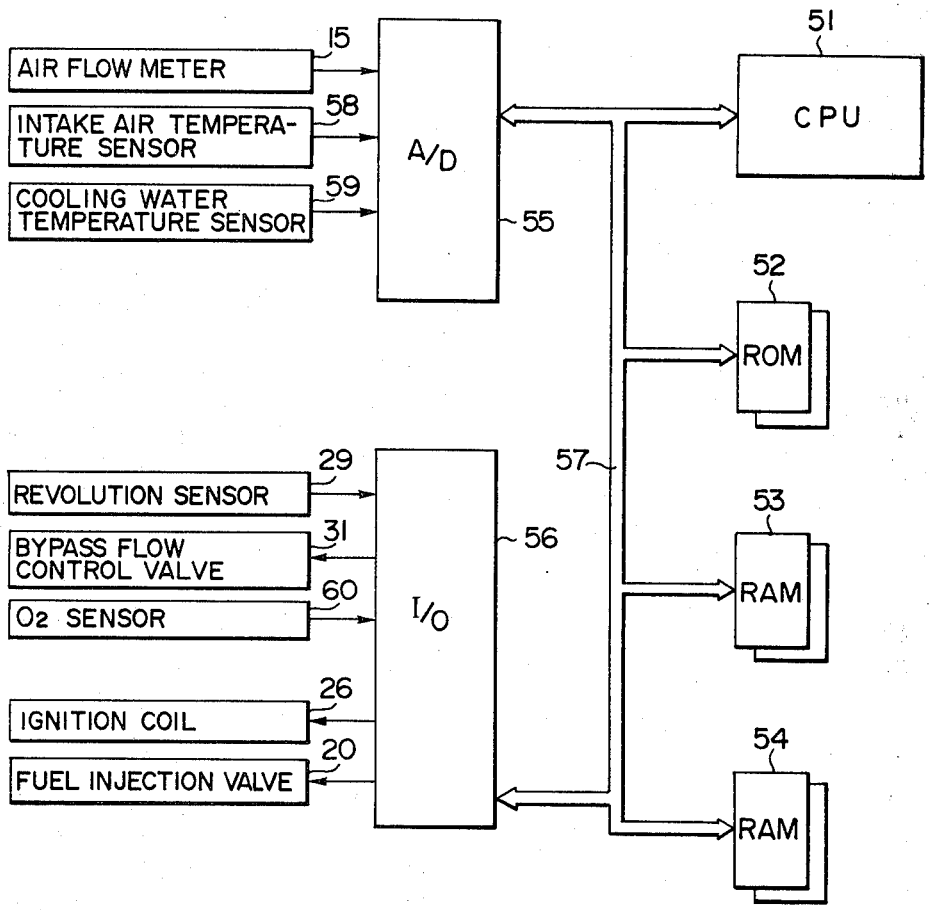
FIG. 2 is a more detailed block diagram, showing the preferred embodiment of the control device according to the present invention for controlling the engine shown in FIG. 1 in more detail with regard to the internal construction of an electronic computer incorporated therein, and also showing parts of said internal combustion engine, also in block diagrammatical form.

The electronic control computer 50 is provided with operating electrical energy by the battery 48. The general large scale internal architecture of this electronic control computer 50 is shown in FIG. 2, and is per se well known and conventional. The control computer 50 comprises: a central processing unit or CPU 51; a read only memory or ROM 52; a random access memory or RAM 53; another random access memory or RAM 54 which provides non volatile data storage—i.e. which preserves the value of the data stored in it even when the control computer 50 is switched off; an analog to digital converter or A/D converter 55, which includes a multiplexer; and an input/output or I/O device 56, which includes a buffer memory. All of these parts are mutually interconnected by a common bus 57.

The A/D converter 55 converts the analog values of the intake air flow amount or rate signal generated by the aforementioned intake air flow meter 15, of the intake air temperature signal generated by the aforementioned intake air temperature sensor 58 attached to the air flow meter 15, and of the cooling water temperature signal generated by the aforementioned cooling water temperature sensor 59 attached to the cylinder block 1, into digital values representative thereof, at appropriate timings under the control of the CPU 51, and feeds these digital values to the CPU 51 and/or the RAM 53 and/or the RAM 54, as appropriate, again at appropriate timings under the control of the CPU 51; the details, based upon the disclosure in this specification, will be easily filled in by one of ordinary skill in the programming art. Further, the I/O device 56 inputs the excess air signal generated by the aforementioned 02 sensor 60 fitted to the exhaust manifold 17 and the crank angle and engine revolution speed signal which is generated by the aforementioned revolution sensor 29 fitted to the distributor 27, and again at appropriate timings under the control of the CPU 51 feeds digital values representative thereof to the CPU 51 and/or the RAM 53 and/or the RAM 54, as appropriate; the details, based upon the disclosure herein, will again be easily filled in by one of ordinary skill in the programming art. The CPU 51 operates as will hereinafter be more particularly described, according to a control program stored in the ROM 52, on these digital data values and others, and from time to time at appropriate timings produces output signals representative of fuel injection time duration and timing, bypass air flow amount, and ignition timing, which are all fed to the I/O device 56. The I/O device 56 processes the signal from the CPU 51 representative of fuel injection time and timing and outputs at proper timings control electrical signals to the fuel injection valve 20 for opening it and for closing it, so as to produce a pulse of injected fuel for the correct required time duration. Further, the I/O device 56 processes the signal from the CPU 51 representative of bypass air flow amount and outputs a control electrical signal to the bypass flow control valve 31 for opening it to the correct amount. Yet further, the I/O device 56 processes the signal from the CPU 51 representative of ignition timing and outputs a control electrical signal to the ignition coil 26 for causing it to produce a spark at the correct timing. Such an I/O device like the I/O device 56 is per se well known in the electronic fuel injection art.

A summary of the way of operation of the electronic control computer 50, which causes the preferred embodiment of the engine control method according to the present invention to be practiced by the preferred embodiment of the engine control device according to the present invention, will now be given.

A main routine of the electronic control computer 50, which will be detailed later with reference to the flow chart of FIG. 3 which is a flow chart of said main routine and the flow chart of FIG. 4 which is a flow chart of a subroutine of said main routine, is executed in a repetitive cycle whenever the ignition circuit of the automotive vehicle incorporating the internal combustion engine 1 is switched on. This main routine loops from its end to substantially its beginning, and one execution of the loop of this main routine takes about three milliseconds, which corresponds, when the crankshaft of the internal combustion engine is rotating at a typical speed of roughly 4000 rpm, to approximately 72° of crank angle. The reason for this fairly long execution time for the main routine is that the main routine performs a considerable amount of calculation, as will be seen hereinafter.

Figure 5:
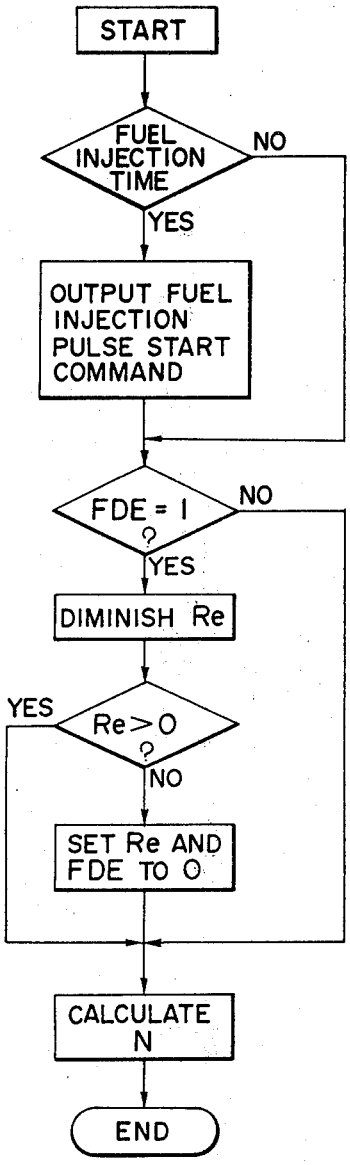
FIG. 5 is another partial flow chart, showing the overall flow of an interrupt routine which is executed repeatedly, according to an interrupt signal which is dispatched by a crank angle sensor, once every time the crankshaft of the engine rotates through an angle of 120°, during the operation of said electronic computer which is incorporated in the preferred embodiment of the engine control device according to the present invention shown in FIGS. 1 and 2 while said engine control device is practicing the preferred embodiment of the engine control method according to the present invention.

In more detail, this main routine calculates the appropriate value for the amount of fuel to be injected to the intake manifold 11 of the internal combustion engine 1 through the fuel injection valve 20 for each engine operational cycle (which, according to engine design, may correspond to one crankshaft revolution through a total angle of 360°, two crankshaft revolutions through a total angle of 720°, or some other value), repeatedly, according to the current or latest values of detected engine operational parameters, i.e. of intake air flow amount or rate as indicated by the signal from the air flow meter 15 and as converted by the A/D converter 55, of cooling water temperature as indicated by the signal from the cooling water temperature sensor 59 and as converted by the A/D converter 55, of intake air temperature as indicated by the signal from the intake air temperature sensor 58 and as converted by the A/D converter 55, of excess air ratio as indicated by the signal from the oxygen sensor 60 and as input by the I/O device 56, and of engine revolution speed as calculated on a repetitive basis during the interrupt routine whose flow chart is shown in FIG. 5 by the CPU 51 from the crank angle and engine revolution speed signal which is generated by the aforementioned revolution sensor 29 fitted to the distributor 27 as input by the I/O device 56. In fact, a basic amount of fuel to be injected is calculated from the current values of engine revolution speed and intake air flow, and then this basic value is corrected according to the values of intake air temperature and cooling water temperature, and also according to the value of the excess air signal dispatched from the oxygen sensor 60 so as to cause the air/fuel ratio of the exhaust gases in the exhaust manifold 17 to home in on the stoichiometric value by a feedback process as already explained. In this calculation, further, according to the principles of the present invention, a determination is made as to whether the internal combustion engine 1 is being decelerated or not, by comparing the current value of intake air flow per engine revolution with an average of the values of intake air flow per engine revolution over the last n cycles of the main routine whose flow chart is shown in FIG. 3, where n is some suitable characteristic number. If the internal combustion engine is fully warmed up and is being decelerated, according to this criterion, the main routine calculates and sets a deceleration increase coefficient Re which is used to increase the amount of fuel injected into the intake manifold 11 of the internal combustion engine 1 through the fuel injection valve 20 for each engine operational cycle, relative to the amount of fuel calculated as a basic amount and corrected according to the values of intake air temperature and cooling water temperature and also according to the value of the excess air signal dispatched from the oxygen sensor 60, as mentioned before. Thus, more fuel is injected during deceleration of the engine when it is hot, which serves to help to prevent the occurrence of engine misfiring and surging and torque fluctuation during these engine operational conditions, as already explained in the section of this specification entitled "BACKGROUND OF THE INVENTION".

An interrupt routine of the electronic control computer 50, which will be detailed later with reference to the flow chart of FIG. 5, is executed whenever as interrupt signal is sent to the electronic control computer 50 from the distributor 27 by the crank angle sensor 29, which occurs at every 120° of crank angle rotation. Accordingly, this interrupt routine is fairly short, because it must be executed by the electronic control computer 50 in a fairly short interval of real time. In this interrupt routine, first, a decision is made as to whether at this particular interrupt instant it is the correct time to inject a pulse of liquid fuel into the inlet manifold 11 through the fuel injection valve 20, or not. If not, the interrupt routine goes to its next stage. If, on the other hand, it is now the proper time to inject fuel, then the interrupt routine outputs a signal whose digital value is representative of the amount of fuel to be injected to the I/O device 56, which as explained above is a per se well known type which is able to control the fuel injection valve 20 to inject a pulse of gasoline for a time duration corresponding to the value of this signal, starting immediately. Next, if the deceleration increase coefficient Re is being used at this time to increase the amount of injected fuel during hot deceleration of the internal combustion engine 1, then said deceleration increase coefficient Re is diminished by a certain fixed amount. This ensures a steady decay with time of the deceleration increase coefficient Re, so that after a certain characteristic time the increasing of the amount of fuel which is injected during hot engine deceleration in order to help to prevent the occurrence of engine misfiring and surging and torque fluctuation during these engine operational conditions is terminated. Then finally, after this reduction of the deceleration increase coefficient Re (if it is being used), just before its termination point, the interrupt routine calculates the latest value of N, the engine revolution speed, from the crank angle signal generated by the engine revolution sensor fitted to the distributor 27, and from readings taken from a real time clock, a timer, or the like.

The I/O device 56, for instance, may comprise a flipflop which is SET by the signal representative of the amount of fuel to be injected, so as to cause its output to be energized, said output of said flipflop being amplified by an amplifier and being supplied to the fuel injection valve 20 so as to open it, and a down counter which is set to the value of said signal representative of the amount of fuel to be injected when said signal is supplied by the CPU 51 of the electronic computer 50, and which counts down from this value according to a clock signal. Further, in this arrangement, when the value in the down counter reaches zero then the down counter RESETs the flipflop, so as to cause its output to cease to be energized, and so as thereby to close the fuel injection valve 20 so as to terminate the supply of liquid fuel into the intake manifold 11 of the internal combustion engine 1. By such an arrangement, the duration of the pulse of injected liquid fuel is made to be proportional to the signal value outputted by the CPU 51 to the I/O device 56; however, other possible arrangements could be envisaged, and the details thereof are not directly relevant to the present invention.

Figure 3:
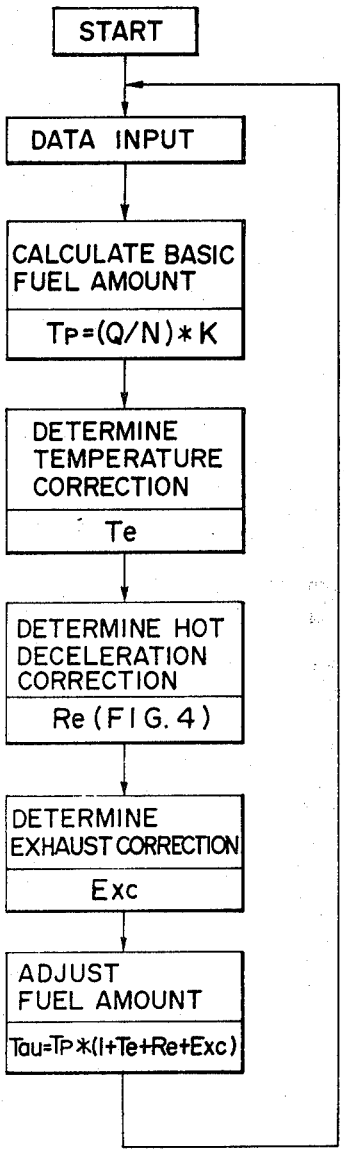
FIG. 3 is a flow chart, showing the overall flow of a main routine which is repeatedly executed at a cycle time of about three milliseconds during the operation of said electronic computer which is incorporated in the preferred embodiment of the engine control device according to the present invention shown in FIGS. 1 and 2 while said engine control device is practicing the preferred embodiment of the engine control method according to the present invention.
Figure 4:
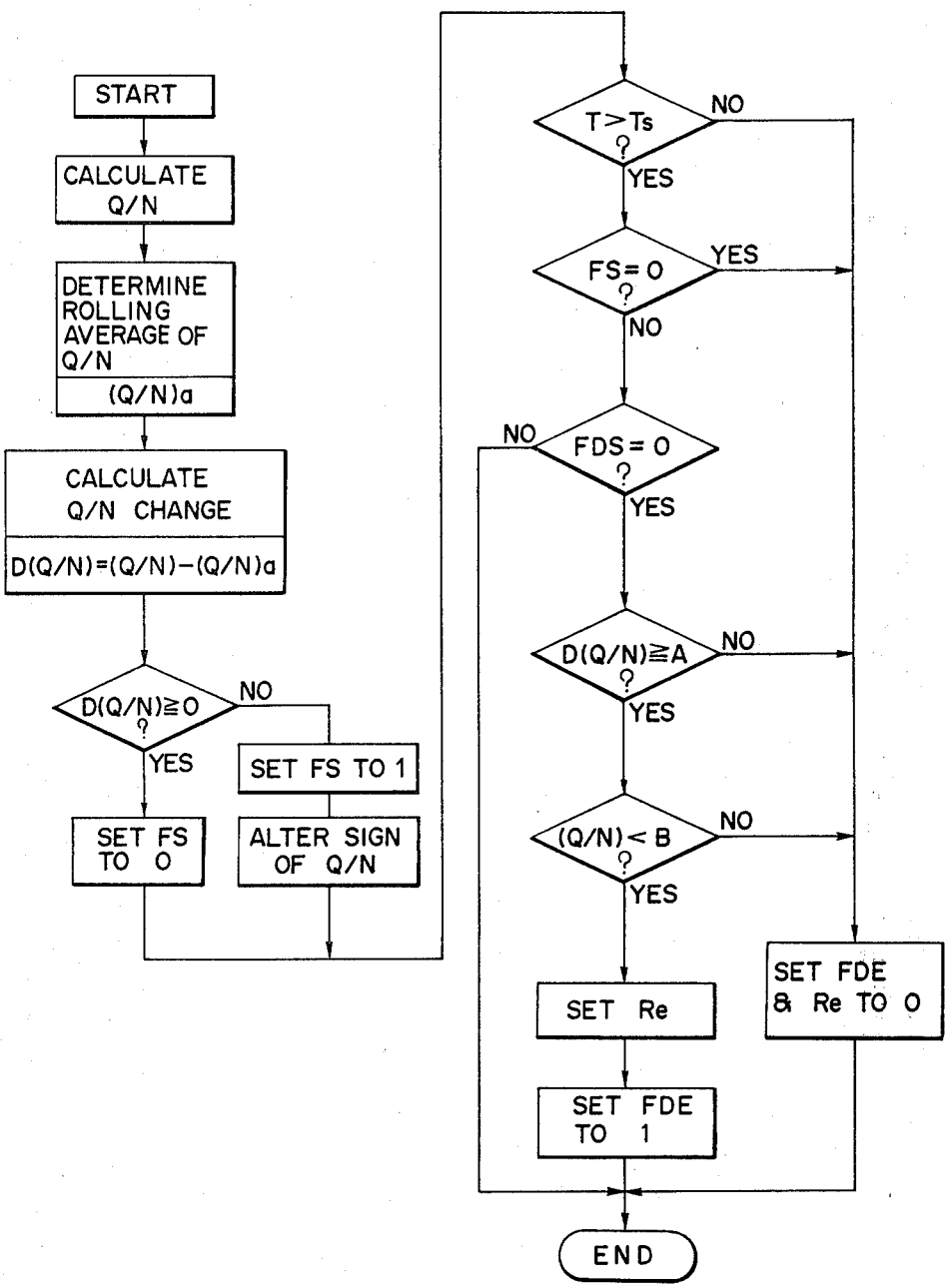
FIG. 4 is a flow chart, showing the overall flow of a subroutine which is called from said main routine whose flow chart is shown in FIG. 3, and which is thus also repeatedly executed during the operation of said electronic computer which is incorporated in the preferred embodiment of the engine control device according to the present invention shown in FIGS. 1 and 2 while said engine control device is practicing the preferred embodiment of the engine control method according to the present invention.

Although it is not particularly shown or explained in any of the flow charts of FIGS. 3 to 5, because it is not directly relevant to the present invention, the electronic control computer 50 also from time to time calculates a suitable bypass air amount, according to the current or latest values of detected engine operational parameters, in particular the values of engine cooling water temperature and intake air temperature, and outputs a signal corresponding to this bypass air amount via the I/O device 56 to the bypass air flow amount control valve 31, which is thus controlled by the I/O device 56 to provide this amount of bypass air to bypass the throttle valve 24. This is principally done to control the idling speed of the internal combustion engine 1. Further, the electronic control computer 50 also outputs a signal to the ignition coil 26, again via the I/O device 56, to cause the ignition coil 26 to produce an ignition spark at the appropriate time. The details of these particular functions of the electronic control computer 50, again, will not particularly be described here because they are per se well known and conventional.

Now the way of operation of the electronic control computer 50 will be explained in detail, with respect to the control computer program stored therein, which causes the preferred embodiment of the engine control method according to the present invention to be practiced by the preferred embodiment of the engine control device according to the present invention. This explanation will be made with the aid of three flow charts of the control program stored therein, which are shown in FIGS. 3, 4 and 5. In fact the actual control computer program of the electronic control computer 50 is written in a computer language, and an understanding of its intimate details is not necessary for understanding the principle of the present invention; many variations could be made without departing from the spirit of the present invention, and accordingly no more detail will be given of the computer program of the electronic control computer 50 in this preferred embodiment of the present invention than will be required by a person skilled in the art, who will be well able to fill in all the omitted detail if he or she requires to do so, based upon the disclosure contained herein. FIG. 3 is a flow chart, showing the overall flow of a main routine which is repeatedly executed at a cycle time of about three milliseconds during the operation of the electronic computer 50.

The flow of control of the electronic control computer 50 starts in the START block, when the internal combustion engine 1 is started up and the ignition circuit thereof is switched on, and in this START block the various flags and other variables of the program are initialized, as will be partially detailed later in this specification, when necessary for understanding. Then the flow of control passes to enter next the DATA INPUT block.

In the DATA INPUT block, which is also the block back to which the flow of control returns at the end of the main routine which is being described, data is read into the electronic control computer 50 relating to the current or latest values of the following engine operational parameters: intake air flow amount or rate as indicated by the signal from the air flow meter 15 and as converted by the A/D converter 55 and supplied to the electronic control computer 50, engine cooling water temperature as indicated by the signal from the cooling water temperature sensor 59 which is converted by the A/D converter 55 and supplied to the electronic control computer 50, intake air temperature as indicated by the signal from the intake air temperature sensor 58 which is converted by the A/D converter 55 and supplied to the electronic control computer 50, and excess air ratio as indicated by the signal from the oxygen sensor 60 which is input by the I/O device 56 and supplied to the electronic control computer 50. As will be seen later in the description of the flow chart of FIG. 5, which is an interrupt routine which is performed every time the crankshaft of the internal combustion engine rotates by 120°, the calculation of the value of the engine revolution speed N is performed in that interrupt routine, according to the crank angle and engine revolution speed signal which is generated by the aforementioned revolution sensor 29 fitted to the distributor 27 as input by the I/O device 56 and supplied to the electronic control computer 50; so this signal from the revolution sensor 29 is not processed in this DATA INPUT block. After the electronic computer 50 has performed the data input functions described above, the flow of control passes to enter next the CALCULATE BASIC FUEL AMOUNT $T_p=(Q/N)*k$ block.

In the CALCULATE BASIC FUEL AMOUNT $T_p=(Q/N)*k$ block, the basic amount of fuel to be injected into the intake manifold 11 of the internal combustion engine 1 through the fuel injection valve 20 is calculated from the current value of Q, which is the intake air flow amount or rate as indicated by the signal from the intake air flow meter 15 and as converted by the A/D converter 55 and supplied to the electronic control computer 50, and from the current value of N, which is the current value of engine revolution speed as calculated by the interrupt routine shown in FIG. 5, as will be explained later. This calculation is performed according to the formula, per se well known in the art, of $Tp=(Q/N)*k$, where the symbol Tp represents the basic amount of fuel to be injected, and where k is a variable amount which represents an output correction for the air flow meter 15. After the electronic computer 50 has performed the calculation described above, the flow of control passes to enter next the DETERMINE TEMPERATURE CORRECTION Te block.

In the DETERMINE TEMPERATURE CORRECTION Te block, a value Te is derived as a temperature correction factor to adjust the basic amount of fuel Tp to be injected into the intake manifold 11 according to the current value of the temperature of the intake air which is being sucked in through the air flow meter 15 into the combustion chambers 5, and according to the current value of the temperature of the cooling water of the internal combustion engine 1. Various methods are already well known in the art for performing this derivation of such a correction factor as Te, and therefore this calculation will not particularly be further described here. For example, table look up may be used. The factor Te is represented as an incremental correction factor, i.e. as the ratio of the desired increase in the injected fuel amount to this injected fuel amount, and could be either positive or in some cases negative. After the electronic computer 50 has performed the determination of Te described above, the flow of control passes to enter next the DETERMINE HOT DECELERATION CORRECTION Re block.

In the DETERMINE HOT DECELERATION CORRECTION Re block, a value Re is derived as a hot deceleration correction factor to adjust the basic amount Tp of fuel to be injected into the intake manifold 11 for the fact that the internal combustion engine 1 is being operated in the decelerating operational mode while fully warmed up, if in fact such is the case. This hot deceleration correction factor derivation relates to the nub of the present invention. In fact, this derivation is performed in a subroutine of this main routine. A flow chart of the operation of this subroutine is given in FIG. 4, and will be explained hereinafter. The factor Re is again represented as an incremental correction factor, i.e. as the ratio of the desired increase in the injected fuel amount to this injected fuel amount. Thus, if no increase in the amount of injected fuel is required, as for instance in the case that the engine 1 is not being decelerated, the value of Re will be zero, as will be seen henceforward. Otherwise, by its nature, as will be seen later, the value of Re is positive; in other words, Re is never negative. After the electronic computer 50 has performed the determination of Re described above, the flow of control passes to enter next the DETERMINE EXHAUST CORRECTION Exc block.

In the DETERMINE EXHAUST CORRECTION Exc block, a value Exc is derived as a exhaust gas air/fuel ratio correction factor to adjust the basic amount Tp of fuel to be injected into the intake manifold 11 according to the current value of the excess air signal dispatched from the oxygen sensor 60 representing the air/fuel ratio of the exhaust gases in the exhaust manifold 17. This value Exc is so adjusted from time to time as to cause the air/fuel ratio in the exhaust manifold 17, over a period of time, to home in on the stoichiometric value by a feedback process, as already outlined. Various methods are, again, already well known in the art for performing this derivation of such an air/fuel ratio correction factor as Exc, and for managing this homing in process, and therefore this calculation will not particularly be further described here. For example, again table look up may be used. The factor Exc is again represented as an incremental correction factor, i.e. as the ratio of the desired increase in the injected fuel amount to this injected fuel amount, and could be either positive or in some cases negative. After the electronic computer 50 has performed the derivation of Exc, the flow of control passes to enter next the ADJUST FUEL AMOUNT $Tau=Tp*(1+Te+Re+Exc)$ block.

In the ADJUST FUEL AMOUNT $Tau=Tp*(1+Te+Re+Exc)$ block, the basic fuel injection amount Tp of fuel to be injected into the intake manifold 11 is adjusted according to these three adjustment factors that have been calculated, i.e. according to Te, Re, and Exc, so as to produce an actual fuel injection amount Tau, which represents the actual amount of gasoline that should be injected into the exhaust manifold 11 of the internal combustion engine 1 for combustion in the combustion chambers 5, taking account of the corrections required for the current value of the intake air temperature, the current value of the engine cooling water temperature, the hot deceleration condition if such is the case, and the current value of the oxygen content of the exhaust gases in the exhaust manifold 17, when the proper time comes for such injection, as will be explained later with respect to the discussion of the interrupt routine whose flow chart is shown in FIG. 5. After the electronic computer 50 has performed this derivation of the actual fuel injection amount Tau, the flow of control returns and passes to enter next the DATA INPUT block, thus repeating the cycle explained above and recalculating the proper or actual amount Tau of fuel for injection through the fuel injection valve 20 into the inlet manifold 11 of the internal combustion engine 1. Thus, the value of the actual fuel injection amount Tau is constantly updated according to possibly changing engine operatioal conditions.

It should be particularly noted that actual outputting of the value of the amount Tau of fuel to be injected, i.e. actual initiation of a pulse of fuel injection through the fuel injection valve 20, never occurs during the time that the electronic computer 50 is executing any part of the cycles of this main routine whose flow chart is shown in FIG. 3 or of the subroutine whose flow chart is shown in FIG. 4; the timings of this main routine and of this subroutine are not particularly fixed, although typically together they may take about three milliseconds to execute, as stated above. The actual command for starting of a pulse of injection of fuel through the fuel injection valve 20 is given by the electronic computer 50 while executing the interrupt routine whose flow chart is shown in FIG. 5, which will be explained later, and which is performed for every 120° of crank angle, according to an interrupt signal dispatched from the revolution sensor 29 fitted to the distributor 27 as input by the I/O device 56, as mentioned earlier.

FIG. 4 is a flow chart, showing the overall flow of a subroutine which is called from said main routine whose flow chart has been shown in FIG. 3 and has just been explained, and which is repeatedly executed during the operation of said electronic computer 50 which is incorporated in the preferred embodiment of the engine control device according to the present invention shown in FIGS. 1 and 2 while said engine control device is practicing the preferred embodiment of the engine control method according to the present invention; and the function of this subroutine is to calculate the value of the hot deceleration correction factor Re which is used to adjust the basic amount Tp of fuel to be injected into the intake manifold 11 for the fact that the internal combustion engine 1 is being operated in the decelerating operational mode while fully warmed up, if in fact such is the case, as already explained above, and is also to set a flag FDE, which according to whether its value is 1 or 0 indicates whether or not hot deceleration increase of injected fuel amount is actually being performed. This flag FDE is provided both for internal use within this subroutine and for use, as will be seen shortly, by the aforementioned interrupt routine whose flow chart is shown in FIG. 5 and which will be explained later. This subroutine whose flow chart is shown in FIG. 4 also uses a flag Fs for internal purposes, and this flag Fs, according to whether its value is 1 or 0, indicates whether the internal combustion engine 1 is currently being decelerated or not.

The flow of control of the electronic control computer 50, in the subroutine, starts in the CALCULATE Q/N block, when the block DETERMINE HOT DECELERATION CORRECTION Re of the flow chart of FIG. 3 passes control to this subroutine, and in this CALCULATE Q/N block the electronic computer 50 calculates the current value of Q/N, i.e. of the basic fuel injection amount required for the internal combustion engine 1, uncorrected for any factors such as those taken account of in the main routine described above and illustrated in FIG. 3. After the electronic computer 50 has performed the calculation described above, then the flow of control passes to enter next the DETERMINE ROLLING AVERAGE OF Q/N block.

In the DETERMINE ROLLING AVERAGE OF Q/N block, a new value of the rolling average of the last n values of Q/N is determined. In more detail, at any particular time, a record is being kept in the random access memory of the electronic computer 50 of the last n values of Q/N that have been determined by this subroutine which is being described, in the last n passes through the CALCULATE Q/N block described above. After entering this DETERMINE ROLLING AVERAGE OF Q/N block, the oldest of these sampled historical values of Q/N is discarded, the present value of Q/N as just determined in the previous CALCULATE Q/N block described above is substituted therefor, and the average of all these sampled values of Q/N is calculated by adding them all together and dividing by n, the result being designated in this flow chart as (Q/N)a. Thus, after execution of this DETERMINE ROLLING AVERAGE OF Q/N block, the value of (Q/N)a is the average of the last n sampled values of Q/N as calculated at the last n instants that the electronic computer 50 has passed through the CALCULATE Q/N block in this subroutine, including the pass through the CALCULATE Q/N block which has just been made. After the electronic computer 50 has performed the computation explained in this block, the flow of control passes to enter next the CALCULATE Q/N CHANGE block.

It should be noted that according to this system of computation of the rolling average of Q/N, as sampled at the last n sampling instants as shown above, these sampling instants need not be and are generally not distributed absolutely regularly in time. In fact, the times of these sampling instants are determined by the amount of time necessary for the control of the electronic digital computer 50 to perform the steps of the main routine whose flow chart is shown in FIG. 3 and the steps of the subroutine whose flow chart is shown in FIG. 4, for each cycle through said main routine and said subroutine, and since the amounts of time necessary for successive performances of these routines are not necessarily the same, and since further the performances of these routines may be interrupted by interrupt routines such as the interrupt routine whose flow chart is shown in FIG. 5, or possibly others, the sampling instants may not occur at regular intervals. However, the sampling instants will occur at approximately regular intervals in general, and since the function of this DETERMINE ROLLING AVERAGE OF Q/N block is to determine a generally average value of Q/N over a certain time period previous to the present instant, therefore the actual length of this time period and the weightings given to the various different values of Q/N in it are not extremely critical, as will be understood by one of ordinary skill in the art based upon the explanation herein. However, if it were determined that extremely regularly spaced sampling instants were necessary to a particular implementation of the present invention, then this could be done by performing this determination of the rolling average of Q/N in an interrupt routine the execution of which by the control of the electronic computer 50 was started according to a clock signal, or the like. The details of this will be easily filled in by one of ordinary skill in the computer art, if required, based upon the explanation herein; and should be understood as falling within the scope of the engine control method and device according to the present invention.

A suitable value of n for this DETERMINE ROLLING AVERAGE OF Q/N block may be of the order of 50. In such a case, the rolling average of the value of Q/N is repeatedly taken over approximately the last 150 milliseconds, i.e. over approximately the last 0.15 second, which is a suitable time interval from the present instant into the past for determining whether the internal combustion engine 1 is being decelerated or not.

In the CALCULATE Q/N CHANGE block, a calculation is made of the difference between the present value of Q/N and the rolling average value of Q/N calculated in the previous DETERMINE ROLLING AVERAGE OF Q/N block. I.e., D(Q/N), the change in Q/N, is calculated as being equal to (Q/N)−(Q/N)a. This, as will be seen shortly, is for determining whether the internal combustion engine 1 is being decelerated or not. After the electronic computer 50 has performed this calculation, the flow of control passes to enter next the IS D(Q/N) GREATER THAN OR EQUAL TO ZERO? decision block.

In the IS D(Q/N) GREATER THAN OR EQUAL TO ZERO? decision block, a decision is made as to whether the current value of D(Q/N) is greater than or equal to zero, or not. If the result of the decision in this IS D(Q/N) GREATER THAN OR EQUAL TO ZERO? decision block is NO, then the flow of control passes to enter next the SET FS TO 1 block, and otherwise if the result of the decision in this IS D(Q/N) GREATER THAN OR EQUAL TO ZERO? decision block is YES, then the flow of control passes next toward the IS T GREATER than Ts? decision block, as explained later.

In the NO branch from this IS D(Q/N) GREATER THAN OR EQUAL TO ZERO? decision block, in the SET FS TO 1 block the flag FS is set to 1 to show that the internal combustion engine is in a deceleration operational situation, since the current value of Q/N is less than the rolling average value of Q/N over a certain previous time interval, and then the flow of control passes to enter next the ALTER SIGN OF D(Q/N) block. In this ALTER SIGN OF D(Q/N) block, the sign of Q/N is altered, so that in other words D(Q/N) is now positive. From this block, the flow of control passes to enter next the IS T GREATER than Ts? decision block.

On the other hand, in the YES branch from this IS D(Q/N) GREATER THAN OR EQUAL TO ZERO? decision block, in the SET FS TO 0 block the flag FS is set to 0 to show that the internal combustion engine 1 is in an acceleration or a constant operational situation, since the current value of Q/N is greater than or equal to the rolling average value of Q/N over a certain previous time interval, and then from this block the flow of control passes to enter next the IS T GREATER than Ts? decision block.

In the IS T GREATER than Ts? decision block, a decision is made as to whether the current value of T, which is the temperature of the cooling water of the internal combustion engine 1 as measured by the cooling water temperature sensor 59, is greater than a certain predetermined fixed temperature Ts, or not. This fixed temperature value Ts is the temperature level, above which according to the logic of this routine it is considered that the internal combustion engine 1 is warmed up, and below which it is considered that the internal combustion engine 1 is not warmed up. If the result of the decision in this IS T GREATER than Ts? decision block is NO, i.e. if the engine 1 is not warmed up, then the flow of control passes to enter next the SET FDE AND Re TO ZERO block, and otherwise if the result of the decision in this IS T GREATER than Ts? decision block is YES, i.e. if the engine 1 is now properly warmed up, then the flow of control passes to enter next the IS FS ZERO? decision block.

In the NO branch from this IS T GREATER than Ts? decision block, since it is decided at this point that the internal combustion engine 1 is still cold, and since thus as explained earlier according to one of the principles of the present invention no increase of the amount of injected fuel is to be made during deceleration when the engine is not warm, thus in the SET FDE AND Re TO ZERO block the value of Re is set to zero to ensure that no particular increase of injected fuel amount is performed in the main routine whose flow chart is shown in FIG. 3, and also the flag FDE is set to 0 to show that hot deceleration increase of injected fuel amount is not currently being performed. Then the flow of control passes to the END of this subroutine, so as to return to the main routine of FIG. 3.

On the other hand, in the YES branch from this IS T GREATER than Ts? decision block, it is decided at this point that the internal combustion engine 1 is warmed up, and next the flow of control passes to enter next the IS FS ZERO? decision block.

In the IS FS ZERO? decision block, a decision is made as to whether the current value of FS, which is the flag set as described above which indicates whether the internal combustion engine 1 is being decelerated or not, is zero or not. If the result of the decision in this IS FS ZERO? decision block is YES, i.e. if the internal combustion engine 1 is at the present time not being decelerated, then the flow of control passes to enter next the SET FDE AND Re TO ZERO block, already described, and otherwise if the result of the decision in this IS FS ZERO? decision block is NO, i.e. if the internal combustion engine 1 is at the present time being decelerated, then the flow of control passes to enter next the IS FDE 1? decision block.

In the YES branch from this IS FS ZERO? decision block, since it is decided at this point that the internal combustion engine 1 is not being decelerated, and since thus of course no increase of the amount of injected fuel is to be made at this time, thus similarly to the previous case in the SET FDE AND Re TO ZERO block the value of Re is set to zero to ensure that no particular increase of injected fuel amount is performed in the main routine whose flow chart is shown in FIG. 3, and also the flag FDE is set to 0 to show that hot deceleration increase of injected fuel amount is not currently being performed. Then as before the flow of control passes to the END of this subroutine, so as to return to the main routine of FIG. 3.

On the other hand, in the NO branch from this IS FS ZERO? decision block, it is decided at this point that the internal combustion engine 1 is being decelerated in the warmed up condition, and next the flow of control passes to enter next the IS FDE 0? decision block.

In the IS FDE 0? decision block, a decision is made as to whether the current value of FDE, which is the flag set as described above which indicates whether hot deceleration injected fuel amount increase has not yet been performed or not, is 0 or not 0. If the result of the decision in this IS FDE 0? decision block is NO, i.e. if hot deceleration injected fuel amount increase is already being performed, as explained hereinunder, then the flow of control passes to the END of this subroutine, so as to return to the main routine of FIG. 3, since obviously there is no requirement to again perform the hot deceleration injected fuel amount increase, and otherwise if the result of the decision in this IS FDE 0? decision block is YES, i.e. if hot deceleration injected fuel amount increase is not already being performed, then the flow of control passes to enter next the IS D(Q/N) GREATER THAN OR EQUAL TO A? decision block.

In the IS D(Q/N) GREATER THAN OR EQUAL TO A? decision block, a decision is made as to whether the current value of D(Q/N), which is the absolute value of the difference between the present value of Q/N and the generally average value of Q/N over the previously explained certain time period previous to the present instant, is greater than a certain threshold level A, or not, i.e. whether the amount of the present deceleration of the internal combustion engine 1 is greater than this threshold value of A, or not. If the result of the decision in this IS D(Q/N) GREATER THAN OR EQUAL TO A? decision block is NO, i.e. if the internal combustion engine 1 is at the present time not being decelerated by a very great amount, i.e. by an amount less than said threshold value of A, then the flow of control passes to enter next the SET FDE AND Re TO ZERO block, already described, and otherwise if the result of the decision in this IS D(Q/N) GREATER THAN OR EQUAL TO A? decision block is YES, i.e. if the internal combustion engine 1 is at the present time being decelerated by an amount greater than said threshold value of A, then the flow of control passes to enter next the IS Q/N LESS THAN B? decision block.

In the NO branch from this IS D(Q/N) GREATER THAN OR EQUAL TO A? decision block, since it is decided at this point that the internal combustion engine 1 is not being decelerated by as much as this threshold value of A, and since according to this decision and according to the logic of this subroutine no increase of the amount of injected fuel should be made at this time, thus similarly to the previous case in the SET FDE AND Re TO ZERO block the value of Re is set to zero to ensure that no particular increase of injected fuel amount is performed in the main routine whose flow chart is shown in FIG. 3, and also the flag FDE is set to 0 to show that hot deceleration increase of injected fuel amount is not currently being performed. Then as before the flow of control passes to the END of this subroutine, so as to return to the main routine of FIG. 3.

On the other hand, in the YES branch from this IS D(Q/N) GREATER THAN OR EQUAL TO A? decision block, it is decided at this point that the internal combustion engine 1 is being decelerated in the warmed up condition by an amount greater than this threshold value of A, and next the flow of control passes to enter next the IS Q/N LESS THAN B? decision block.

In the IS Q/N LESS THAN B? decision block, a decision is made as to whether the current value of Q/N, which is the approximate amount of air being sucked into the combustion chambers 5 per one revolution of the crankshaft of the internal combustion engine 1, is less than a certain threshold level B, or not. The meaning of this test is that, in the case of the internal combustion engine 1 racing or overrevving, the air flow meter 15 will probably overshoot, and because of this it is quite possible for the value of D(Q/N) tested in the IS D(Q/N) GREATER THAN OR EQUAL TO A? decision block to be greater than the predetermined value of A, quite irrespective of whether in fact the internal combustion engine 1 is actually being decelerated or not. However, if the engine 1 is racing, the value of Q/N will be greater than a threshold value B which is quite large, and accordingly this test is in order to check whether the internal combustion engine 1 is racing or not. If the result of the decision in this IS Q/N LESS THAN B? decision block is NO, i.e. if the internal combustion engine 1 is racing at the present time, then the flow of control passes to enter next the SET FDE AND Re TO ZERO block, already described, and otherwise if the result of the decision in this IS Q/N LESS THAN B? decision block is YES, i.e. if the internal combustion engine 1 is at the present time not racing, then the flow of control passes to enter next the SET Re block.

In the NO branch from this IS Q/N LESS THAN B? decision block, since it is decided at this point that the internal combustion engine 1 is racing, and since according to this decision and according to the logic of this subroutine no increase of the amount of injected fuel should be made at this time, this similarly to the previous cases in the SET FDE AND Re TO ZERO block the value of Re is set to zero to ensure that no particular increase of injected fuel amount is performed in the main routine whose flow chart is shown in FIG. 3, and also the flag FDE is set to 0 to show that hot deceleration increase of injected fuel amount is not currently being performed. Then as before the flow of control passes to the END of this subroutine, so as to return to the main routine of FIG. 3.

On the other hand, in the YES branch from this IS Q/N LESS THAN B? decision block, it is decided at this point that the internal combustion engine 1 is not racing. Further, it has already been determined that the internal combustion engine 1 is being decelerated, and is warmed up, and is beind decelerated by an amount greater than the threshold amount of A, so that finally it can be decided definitely to perform increase of the amount of fuel which is injected through the fuel injection valve 20 into the intake manifold 11 of the internal combustion engine 1. Thus, next the flow of control passes to enter next the SET Re block.

In this SET Re block, the value of the hot deceleration injected fuel increase coefficient Re is determined according to some criteria. In the simplest possible form of this hot deceleration injected fuel increase concept, Re is set to be a simple constant number, such as Y%, where Y is a constant determined according to engine characteristics. However, it would be quite within the scope of the present invention for Re to be made to depend on various of the variables which are being processed by the electronic computer 50, such as the current value of D(Q/N), which is indicative of the amount of hot deceleration currently being undergone by the internal combustion engine 1, for example. From this SET Re block, the flow of control passes to enter next the SET FDE TO 1 block.

In this SET FDE TO 1 block, the value of the flag FDE is set to 1, which means that hot deceleration increase of injected fuel amount is currently being performed. Thus, when next this subroutine whose flow chart is shown in FIG. 4 is repeated approximately three milliseconds later upon being called again by the main routine whose flow chart is shown in FIG. 3, because the value of the flag FDE is now set to 1 when before it was set to zero, thereby in the IS FDE 0? decision block, above, the result of the decision will be NO this time around, and therefore the flow of control will now this time proceed directly to the END of this subroutine, so as to return to the main routine whose flow chart is shown in FIG. 3, without resetting the value of Re which of course would be incorrect, as will be seen later with reference to the part of the interrupt routine whose flow chart is shown in FIG. 5 which steadily decreases the value of Re. This avoiding of again setting the value of Re will continue for as long as hot deceleration continues, or until the value of Re eventually reaches zero as will be seen later; in other words, the value of the flag FDE will continue to be 1 until either hot deceleration completely ceases or a certain characteristic number of engine revolutions have been performed since the start of hot deceleration injected fuel increase, in either of which cases the value of the flag FDE will be reset to zero so as to allow another spell of hot deceleration injected fuel increase, if the conditions therefor are fulfilled as seen in this subroutine whose flow chart is given in FIG. 4. Finally, after this SET FDE TO 1 block, the flow of control passes to the END of this subroutine, so as to return to the main routine of FIG. 3.

FIG. 5 is another partial flow chart, showing the overall flow of an interrupt routine which is executed repeatedly, once every time the crankshaft of the engine rotates through an angle of 120°, during the operation of said electronic computer which is incorporated in the preferred embodiment of the engine control device according to the present invention shown in FIGS. 1 and 2 while said engine control device is practicing the preferred embodiment of the engine control method according to the present invention. The performance of the computer program which is currently being executed by the electronic computer 50, which may well be either the main routine whose flow chart is given in FIG. 3 or the subroutine whose flow chart is given in FIG. 4, is interrupted every time a crank angle signal is received by the I/O device 56 from the crank angle sensor 29 fitted to the distributor 27, and the computer program of FIG. 5 is then immediately preferentially executed instead.

The electronic computer 50, during the execution of this interrupt routine, performs in sequence three distinct functions. First, it decides whether or not it is currently a time for injecting a pulse of fuel of duration and amount determined by the current value of Tau through the fuel injection valve 20, and if this is the case then the electronic computer 50 outputs a command to commence said fuel injection pulse of duration determined by the current value of Tau. Second, the electronic computer 50, if currently hot deceleration increase of injected fuel amount is currently being performed, diminishes the value of the hot deceleration injected fuel amount increase coefficient Re by a certain amount, so that after a certain number of repetitions of this interrupt routine the value of said hot deceleration injected fuel amount increase coefficient Re becomes less than or equal to zero. Third, the electronic computer 50 calculates the current value N of engine revolution speed.

The flow of control of the electronic control computer 50, in the interrupt routine, starts at the FUEL INJECTION TIME? decision block.

In the FUEL INJECTION TIME? decision block, a decision is made as to whether the present crank angle interrupt, which has occurred because the event has occurred that the crankshaft of the internal combustion engine 1 has turned through 120° of crank angle from the last such interrupt, i.e. that the crankshaft of the internal combustion engine 1 has reached the next one of three points in the crank angle diagram which are spaced apart from one another by angles of 120° around said crank angle diagram (such as, for example, the points 0°, 120°, and 240°, or the like, according to the particular construction of the distributor 27 and of the crank angle sensor 29), is a interrupt at which a pulse of fuel (of duration and amount corresponding to the current value of Tau) should be injected into the intake manifold 11 of the internal combustion engine 1 through the fuel injection valve 20, or not. The meaning of this test is that, depending upon the particular construction of the fuel injection system of the internal combustion engine 1, fuel injection may be designed to occur once per crankshaft revolution, or possibly once per two crankshaft revolutions, or at some other occurrence frequency. In any case, the time between the starting instants of successive pulses of fuel injection should be an integral multiple of the time between successive computer interrupts caused by the crankshaft rotating through 120°, i.e. successive pulses of fuel injection should start at points in the crank angle diagram spaced apart angles which are some multiple of 120°. Thus, this FUEL INJECTION TIME? decision block serves to decide whether this particular interrupt is in fact a fuel injection interrupt. This decision can be based upon, for example, counting upwards in a counter which is reset at the start of every fuel injection pulse, or the like; the details will easily be completed by one of ordinary skill in the computer art, based upon the disclosure herein. If the result of the decision in this FUEL INJECTION TIME? decision block is YES, i.e. if this particular interrupt is in fact a fuel injection interrupt, then the flow of control passes to enter next the OUTPUT FUEL INJECTION PULSE START COMMAND block, and otherwise if the result of the decision in this FUEL INJECTION TIME? decision block is NO, i.e. if this particular interrupt is in fact not a fuel injection interrupt, then the flow of control passes to enter next the FDE=1? decision block.

In the YES branch from this FUEL INJECTION TIME? decision block, it is decided at this point that this particular interrupt is in fact a fuel injection interrupt, and therefore at this point actual fuel injection should be initiated. Therefore, the flow of control passes to enter next the OUTPUT FUEL INJECTION PULSE START COMMAND block.

In this OUTPUT FUEL INJECTION PULSE START COMMAND block, the value of the proper or actual amount Tau of fuel for injection through the fuel injection valve 20 into the inlet manifold 11 of the internal combustion engine 1, this value Tau as already explained being constantly updated according to possibly changing engine operational conditions, is output to the I/O device 56. As previously mentioned, the I/O device 56, for instance, may comprise a flipflop which is SET by this signal representative of the amount Tau of fuel to be injected, so as to cause its output to be energized, said output of said flipflop being amplified by an amplifier and being supplied to the fuel injection valve 20 so as to open it, and a down counter which is set to the value Tau of said signal representative of the amount of fuel to be injected when said signal is supplied by the CPU 51 of the electronic computer 50, and which counts down from this value Tau according to a clock signal. Further, in this arrangement, when the value in the down counter reaches zero then the down counter RESETs the flipflop, so as to cause its output to cease to be energized, and so as thereby to close the fuel injection valve 20 so as to terminate the supply of liquid fuel into the intake manifold 11 of the internal combustion engine 1. By such an arrangement, the duration of the pulse of injected liquid fuel is made to be proportional to the signal value Tau outputted by the CPU 51 to the I/O device 56; however, other possible arrangements could be envisaged, and the details thereof are not directly relevant to the present invention. In any case, functionally, the I/O device 56, when it receives an output signal of value equal to Tau the desired fuel injection pulse time from the electronic computer 50, substantially immediately opens the fuel injection valve 20 by proper supply of actuating electrical energy thereto, and keeps said fuel injection valve 20 open until an amount of fuel corresponding to the value of Tau has been supplied therethrough into the intake manifold 11 of the internal combustion engine 1 to be combusted in the combustion chambers 5 thereof. From this OUTPUT FUEL INJECTION PULSE START COMMAND block, the flow of control passes to enter next the FDE=1? decision block.

On the other hand, in the NO branch from this FUEL INJECTION TIME? decision block, since it is decided at this point that this particular interrupt is in fact not a fuel injection interrupt, then the flow of control skips and passes directly to the FDE=1? decision block.

When control has arrived at this FDE=1? decision block, the matter of initiating fuel injection, if such fuel injection in fact is proper at this time, has been attended to by this interrupt routine, and next the matter of progressively diminishing Re, if such diminishing is necessary, is attended to, as will now be explained. In the FDE=1? decision block, a decision is made as to whether the current value of the flag FDE is one or not, i.e. as to whether at the present time hot deceleration injected fuel increase is being performed or not. If the result of the decision in this FDE=1? decision block is NO, i.e. if hot deceleration injected fuel increase is not currently being performed, then the flow of control passes to enter next the CALCULATE N block, and otherwise if the result of the decision in this FDE=1? decision block is YES, i.e. if hot deceleration injected fuel increase is currently being performed, then the flow of control passes to enter next the DIMINISH Re block.

In the NO branch from this FDE=1? decision block, it is decided at this point that hot deceleration injected fuel increase is not currently being performed, and therefore at this point no reducing of Re is required, since as will be understood from the flow charts given previously Re will be, and should be, equal to zero at this time. Therefore, the flow of control passes to enter next the CALCULATE N block.

In this CALCULATE N block, as will be more particularly explained later, the electronic control computer 50 calculates the new current value of engine revolution speed N. From this CALCULATE N block, the flow of contol passes to the END of this subroutine, so as to return to the main routine of FIG. 3.

On the other hand, in the YES branch from this FDE=1? decision block, since it is decided at this point that hot deceleration injected fuel increase is currently being performed, and since, according to the logic of the control program of this electronic computer 50 incorporated in this shown preferred embodiment of the engine control device according to the present invention which practices the preferred embodiment of the engine control method according to the present invention, the amount of this hot deceleration injected fuel increase is to be progressively decreased by a certain fixed amount per each 120° of crankshaft rotation, thus, next, the flow of control of the electronic computer 50 passes to the DIMINISH Re block.

In this DIMINISH Re block, Re is diminished by a certain fixed amount, typically by an amount which represents a few percent of the largest value of Re, to which it is set in the subroutine whose flow chart is shown in FIG. 4. Thus, every time this interrupt routine which is being described is executed, the current value of Re is diminished by this certain amount, and so after a fixed number of repetitions of this interrupt routine, which correspond to a fixed number of crankshaft revolutions, since this interrupt routine is executed three times for every complete crankshaft revolution, Re will become zero or negative. The effect of this is that, after hot deceleration injected fuel amount increase is first performed by the subroutine whose flow chart has been shown in FIG. 4 as has already been explained, the amount of this hot deceleration injected fuel amount increase (controlled by the value of Re) is decreased steadily with rotation of the crankshaft of the internal combustion engine 1, until this hot deceleration injected fuel increase becomes zero, after which the process of increasing the amount of injected fuel during this hot deceleration is terminated, as will be seen in the explanation of the next block. This is an agreement with experimental determinations that have been previously mentioned, which have shown that the problem of misfiring and consequent engine surging during hot deceleration of the engine, which as mentioned above can be cured by increasing the amount of fuel injected into the internal combustion engine at this time, does not significantly recur if the amount of extra fuel supplied during hot deceleration is gradually reduced to zero over a suitable time period. Then, from this DIMINISH Re block, the flow of control passes to the Re GREATER THAN ZERO? decision block.

In the Re GREATER THAN ZERO? decision block, a decision is made as to whether the value of Re has reached or passed zero in the process of repeatedly diminishing Re with each cycle of this interrupt routine, or not. Of course, Re should not be allowed to become negative. Thus, this Re GREATER THAN ZERO? decision block serves to decide whether the process of diminishing Re has been carried to its conclusion. If the result of the decision in this Re GREATER THAN ZERO? decision block is NO, i.e. if in fact Re has been diminished up to or past the zero point, then the flow of control passes to enter next the SET Re AND FDE TO ZERO block, and otherwise if the result of the decision in this Re GREATER THAN ZERO? decision block is YES, i.e. if Re is still positive so that the process of diminishing Re should not be stopped, then the flow of control passes to enter next the CALCULATE N block.

In the NO branch from this Re GREATER THAN ZERO? decision block, it is decided at this point that the process of diminishing Re has been carried to its conclusion, and therefore at this point the flow of control passes to enter next the SET Re AND FDE TO ZERO block.

In this SET Re AND FDE TO ZERO block, the value of Re is set to zero, so that Re can never be less than zero which would be erroneous, and also the value of the flag FDE is set to zero, so that in the next call of this interrupt routine which is being described Re is no longer diminished, and also so that in the next cycle of the main routine whose flow chart is given in FIG. 3 and of the subroutine whose flow chart is given in FIG. 4 the possibility of again making a hot deceleration injected fuel increase is made available. From this SET Re AND FDE TO ZERO block, the flow of control passes to the CALCULATE N block.

On the other hand, in the YES branch from this Re GREATER THAN ZERO? decision block, since it is decided at this point that the process of diminishing Re has not yet been carried to its conclusion, therefore the flow of control skips and passes directly to the CALCULATE N block.

When control has arrived at this CALCULATE N block, the matters of initiating fuel injection, if such fuel injection in fact is proper at this time, and of diminishing Re, if such diminishing is necessary, have been attended to by this interrupt routine, and finally the matter of calculating the new current value of engine revolution speed N, as will now be explained, is attended to. Thus, in this block, the electronic computer 50 calculates the current or newest value of N, by consulting a real time clock to find how much real time has elapsed during the last 120° of rotation of the crankshaft of the internal combustion engine, for example; although other ways could be considered. Again, the details of this calculation are per se well known in various forms to those skilled in the art, and are not directly relevant to the present invention. After this CALCULATE N block, the flow of control passes to the END of this interrupt routine, so as to return to the current control point of the program which was interrupted by the interrupt which caused the calling of this interrupt routine, which may well be the main routine whose flow chart is given in FIG. 3 or the subroutine whose flow chart is given in FIG. 4, or could conceivably be some other routine, such as another interrupt routine, which was being executed by the control of the electronic computer 50.

Although the present invention has been shown and described with reference to a preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiment, or of the drawings, but solely by the scope of the appended claims, which follow.

What is claimed is:

1. For an internal combustion engine comprising an intake manifold and a fuel injection valve fitted to said intake manifold which is selectively opened and closed by selective supply of an actuating signal thereto and which when so opened injects liquid fuel into said intake manifold, said internal combustion engine having an operational cycle:

an engine control method, comprising the processes, repeatedly and simultaneously performed, of:

(a) sensing the flow rate of air into said intake manifold with an intake air flow meter which measures the flow rate of air into said intake manifold and which outputs an intake air flow rate signal representative of said air flow rate;

(b) sensing the revolution of said internal combustion engine with an engine revolution sensor which responds to revolution of said internal combustion engine and which outputs an engine revolution signal representative of said internal combustion engine revolution;

(c) determining at a sequence of instants separated by successive intervals successive instances of the value of a first quantity approximately representing the proper amount of fuel to be injected through said fuel injection valve, said determination being at least partly based upon said intake air flow rate signal and said engine revolution signal;

(d) performing the following processes in the specified order:

(d0) determining the current value of a second quantity approximately representing the actual amount of fuel to be injected through said fuel injection valve, said determination being at least partly based upon said intake air flow rate signal and said engine revolution signal;

(d1) determining an average value of all said successive instances of the value of said first quantity approximately representing the proper amount of fuel to be injected through said fuel injection valve which have been determined in some time interval up to the present;

(d2) comparing the current value of said first quantity approximately representing the proper amount of fuel to be injected through said fuel injection valve with said average value and based thereupon determining whether or not said internal combustion engine is being decelerated at the present time, by comparing said current value with said average value;

(d3) if, according to said comparison, it is so determined that said internal combustion engine is being decelerated at the present time, and if it is also determined that said internal combustion engine is fully warmed up at the present time, adjusting the current value of said second quantity approximately representing the actual amount of fuel to be injected through said fuel injection valve by increasing it somewhat, so as to produce an adjusted value corresponding to the actual fuel amount; and optionally (d4) further adjusting said adjusted value corresponding to the actual fuel amount;

and (e) at proper fuel injection points in said operational cycle of said internal combustion engine, modifying said actuating signal according to the current adjusted value of said second quantity and supplying the modified actuating signal to said fuel injection valve in such a fashion as to cause said fuel injection valve to open for a time period which will allow an amount of fuel approximately equal to the fuel amount represented by said current adjusted value of said second quantity corresponding to the actual fuel amount to pass through said fuel injection valve so as to be injected into said intake manifold.

2. An engine control method according to claim 1, wherein said first quantity is calculated by dividing said intake air flow rate as measured by said intake air flow rate signal output by said intake air flow meter by the revolution speed of said internal combustion engine as measured by said engine revolution signal output by said engine revolution sensor.

3. An engine control method according to claim 1, wherein said second quantity is calculated by dividing said intake air flow rate as measured by said intake air flow rate signal output by said intake air flow meter by the revolution speed of said internal combustion engine as measured by said engine revolution signal output by said engine revolution sensor, and by then adjusting this value by multiplication by a certain constant value.

4. An engine control method according to claim 1, wherein said adjusted value corresponding to the actual fuel amount is further adjusted according to the temperature of the air flowing into the intake manifold.

5. An engine control method according to claim 1, wherein said adjusted value corresponding to the actual fuel amount is further adjusted according to the air/fuel ratio of the exhaust gases from the engine.

6. An engine control method according to claim 1, wherein the time interval up to the present over which said average value of all said successive instances of said value of said first quantity approximately representing the proper amount of fuel to be injected through said fuel injection valve is determined is in each repeated case of determination such a time interval up to the present that contains the same constant number of said instances of said value.

7. An engine control method according to claim 1, wherein the amount of said adjustment to increase somewhat the current value of said second quantity approximately representing the proper amount of fuel to be injected through said fuel injection valve performed in step (d3) is set to maximum when first according to said comparison in step (d2) it is so determined that said internal combustion engine is being decelerated at the present time and it is also determined that said internal combustion engine is fully warmed up at the present time, and from this time said amount of said adjustment to increase somewhat the current value of said second quantity approximately representing the proper amount of fuel to be injected through said fuel injection valve is gradually decreased until it reaches zero.

8. For an internal combustion engine comprising an intake manifold and a fuel injection valve fitted to said intake manifold which is selectively opened and closed by selective supply of a fuel injection valve actuating signal thereto and which when so opened injects liquid fuel into said intake manifold, said internal combustion engine having an operational cycle:

an engine control device, comprising:

(a) an intake air flow meter which repeatedly measures the flow rate of air into said intake manifold and which outputs an intake air flow rate electrical signal representative of said air flow rate;

(b) an engine revolution sensor which repeatedly responds to revolution of said internal combustion engine and which outputs an engine revolution electrical signal representative of said internal combustion engine revolution;

(c) an I/O device, which, whenever it receives a fuel injection valve control electrical signal, dispatches said fuel injection valve actuating signal to said fuel injection valve;

and (d) an electronic computer, which receives supply of said intake air flow rate electrical signal and of said engine revolution electrical signal;

(e) said electronic computer repeatedly determining at a sequence of instants separated by successive intervals successive instances of the value of a first quantity approximately representing the proper amount of fuel to be injected through said fuel injection valve, said determination being at least partly based upon said intake air flow rate electrical signal and said engine revolution electrical signal; and also repeatedly performing the following processes in the specified order:

(e0) determining the current value of a second quantity approximately representing the actual amount of fuel to be injected through said fuel injection valve, said determination being at least partly based upon said intake air flow rate electrical signal and said engine revolution electrical signal;

(e1) determining an average value of all said successive instances of said value of said first quantity approximately representing the proper amount of fuel to be injected through said fuel injection valve which have been determined in some time interval up to the present;

(e2) comparing the current value of said first quantity approximately representing the proper amount of fuel to be injected through said fuel injection valve with said average value and based thereupon determining whether or not said internal combustion engine is being decelerated at the present time, by comparing said current value with said average value;

(e3) if, according to said comparison, it is so determined that said internal combustion engine is being decelerated at the present time, and if it is also determined that said internal combustion engine is fully warmed up at the present time, adjusting the current value of said second quantity approximately representing the proper amount of fuel to be injected through said fuel injection valve by increasing it somewhat, so as to produce an adjusted value corresponding to the actual fuel amount; and optionally (e4) further adjusting said adjusted value corresponding to the actual fuel amount;

(f) said electronic computer also at proper fuel injection points in said operational cycle of said internal combustion engine supplying said adjusted second quantity to said I/O device, so as to cause said I/O device to dispatch said fuel injection valve actuating signal according to said adjusted second quantity to said fuel injection valve in such a fashion as to cause said fuel injection valve to open for a time period which will allow an amount of fuel approximately equal to the fuel amount represented by said current adjusted value of said second quantity corresponding to the actual fuel amount to pass through said fuel injection valve so as to be injected into said intake manifold.

9. An engine control device according to claim 8, wherein said electronic computer calculates said first quantity by dividing said intake air flow rate as measured by said intake air flow rate electrical signal output by said intake air flow meter by the revolution speed of said internal combustion engine as measured by said engine revolution electrical signal output by said engine revolution sensor.

10. An engine control device according to claim 8, wherein said electronic computer calculates said second quantity by dividing said intake air flow rate as measured by said intake air flow rate electrical signal output by said intake air flow meter by the revolution speed of said internal combustion engine as measured by said engine revolution electrical signal output by said engine revolution sensor, and by then adjusting this value by multiplication by a certain constant value.

11. An engine control device according to claim 8, wherein said adjusted value corresponding to the actual fuel amount is further adjusted according to the temperature of the air flowing into the intake manifold.

12. An engine control device according to claim 8, wherein said adjusted value corresponding to the actual fuel amount is further adjusted according to the air/fuel ratio of the exhaust gases from the engine.

13. An engine control device according to claim 8, wherein the time interval up to the present over which said electronic computer determines said average value of all said successive instances of said value of said first quantity approximately representing the proper amount of fuel to be injected through said fuel injection valve is in each repeated case of determination that time interval up to the present containing the same constant number of said instances of said value.

14. An engine control device according to claim 8, wherein said electronic computer in step (d3) sets to maximum the amount of said adjustment to increase it somewhat of the current value of said second quantity approximately representing the proper amount of fuel to be injected through said fuel injection valve when first according to said comparison in step (d2) it is so determined that said internal combustion engine is being decelerated at the present time and it is also determined that said internal combustion engine is fully warmed up at the present time, and from this time said electronic computer gradually decreases the amount of said adjustment to increase it somewhat of the current value of said second quantity approximately representing the proper amount of fuel to be injected through said fuel injection valve until it reaches zero.

* * * * *